US008006971B2

(12) United States Patent
Iguchi et al.

(10) Patent No.: US 8,006,971 B2
(45) Date of Patent: Aug. 30, 2011

(54) SHEET STACK APPARATUS AND SHEET STACKING METHOD

(75) Inventors: Ken Iguchi, Shizuoka-ken (JP); Hiroyuki Taguchi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 343 days.

(21) Appl. No.: 12/203,732

(22) Filed: Sep. 3, 2008

(65) Prior Publication Data

US 2009/0065999 A1 Mar. 12, 2009

Related U.S. Application Data

(60) Provisional application No. 60/980,730, filed on Oct. 17, 2007, provisional application No. 60/971,552, filed on Sep. 11, 2007.

(30) Foreign Application Priority Data

Aug. 13, 2008 (JP) ..... P2008-208379
Aug. 13, 2008 (JP) ..... P2008-208380

(51) Int. Cl.
*B65H 37/04* (2006.01)

(52) U.S. Cl. ..... 270/58.11; 270/58.07; 270/58.08; 270/58.12; 270/58.17; 270/58.27

(58) Field of Classification Search ..... 270/58.07, 270/58.08, 58.11, 58.12, 58.17, 58.27
See application file for complete search history.

(56) References Cited

U.S. PATENT DOCUMENTS

| | | | | |
|---|---|---|---|---|
| 6,398,203 | B1 * | 6/2002 | Saito et al. | 270/58.12 |
| 7,537,206 | B2 * | 5/2009 | Tokuno | 270/58.12 |
| 7,571,904 | B2 * | 8/2009 | Bober | 270/58.12 |
| 2005/0258585 | A1 | 11/2005 | Reeves et al. | |
| 2007/0065202 | A1 * | 3/2007 | Tokuno | 399/407 |

FOREIGN PATENT DOCUMENTS

| | | |
|---|---|---|
| JP | 2005-330108 | 12/2005 |
| JP | 2007-076862 | 3/2007 |

* cited by examiner

*Primary Examiner* — Leslie A Nicholson, III
(74) *Attorney, Agent, or Firm* — Patterson & Sheridan, LLP

(57) ABSTRACT

A sheet stack apparatus comprises a storage portion configured to support sheets conveyed one by one in a standing position, a receiving portion configured to receive lower ends of the sheets supported by the storage portion, an assisting member configured to move from a first position to the storage portion side and at a second position where the assisting member contacts with the sheets conveyed to the storage portion, assist stacking of the sheets on the storage portion, and a holding member configured to move in correspondence with a movement of the assisting member via an attaching portion, when the assisting member is at the second position, separate from the lower ends of the sheets, and when the assisting member is at the first position where the assisting member is separated from the sheets supported by the storage portion, contact with the lower ends of the sheets, thereby hold them on the storage portion side.

9 Claims, 13 Drawing Sheets

SHEET STACK APPARATUS AND SHEET STACKING METHOD

CROSS-REFERENCE TO RELATED APPLICATION

This application is based upon and claims the benefit of priority from the prior U.S. Patent Application No. 60/971,552, filed on Sep. 11, 2007, and U.S. Patent Application No. 60/980,730, filed on Oct. 17, 2007; the entire contents of all of which are incorporated herein by reference.

This application is also based upon and claims the benefit of priority from the prior Japanese Patent Application No. 2008-208379, filed on Aug. 13, 2008, and Japanese Patent Application No. 2008-208380, filed on Aug. 13, 2008; the entire contents of all of which are incorporated herein by reference.

FIELD OF THE INVENTION

The present invention relates to a sheet stack apparatus for stacking sheets conveyed and a sheet stacking method.

DESCRIPTION OF THE BACKGROUND

Japanese Patent Application Publication No. 2005-330108 discloses a sheet post-processing apparatus for performing processes such as stitching and folding.

The apparatus includes a sheet stack for stacking sheets for automatic stapling and at least one finger attached movably on the mount for specifying the main surface in contact with the uppermost sheet on the sheet stack in parallel. As the sheets on the stack are increased, to permit the finger to keep continuously in contact with the sheets in parallel, the mount can move for the stack. The weight of the finger prevents the sheets in the receiving tray from being bent and curved.

However, in the apparatus aforementioned, the finger is kept continuously in contact with the sheets in parallel by it own weight and the sheet stack is structured so as to stack sideways the sheets. Therefore, the apparatus cannot respond to the bending and curling of the lower ends of the sheets supported in a standing position.

Further, a problem arises that in addition to the means for driving the stack belt for promoting stacking of sheets, a motor and a solenoid for moving the finger are necessary separately.

SUMMARY OF THE INVENTION

A sheet stack apparatus is provided in an embodiment of the present invention and the sheet stack apparatus comprises a storage portion configured to support sheets conveyed one by one in a standing position; a receiving portion configured to receive lower ends of the sheets supported by the storage portion; an assisting member configured to move from a first position to the storage portion side and at a second position where the assisting member contacts with the sheets conveyed to the storage portion, assist stacking of the sheets on the storage portion; and a holding member configured to move in correspondence with a movement of the assisting member via an attaching portion, when the assisting member is at the second position, separate from the lower ends of the sheets, and when the assisting member is at the first position where the assisting member is separated from the sheets supported by the storage portion, contact with the lower ends of the sheets, thereby hold them on the storage portion side.

Furthermore, a sheet stacking method is provided in an embodiment of the present invention and the sheet stacking method comprises supporting sheets conveyed one by one in a storage portion in a standing position; receiving lower ends of the sheets supported in the storage portion; moving an assisting member from a first position to a side of the storage portion and at a second position where the assisting member contacts with the sheets conveyed to the storage portion, assisting stacking of the sheets on the storage portion; and moving a holding member in correspondence with a movement of the assisting member via an attaching portion, when the assisting member is at the second position, separating the holding member from the lower ends of the sheets, and when the assisting member is at the first position where the assisting member is separated from the sheets supported by the storage portion, allowing the holding member to contact with the lower ends of the sheets.

DETAILED DESCRIPTION OF THE INVENTION

Hereinafter, the embodiments of the present invention will be explained with reference to the accompanying drawings.

First Embodiment

Figure 1:
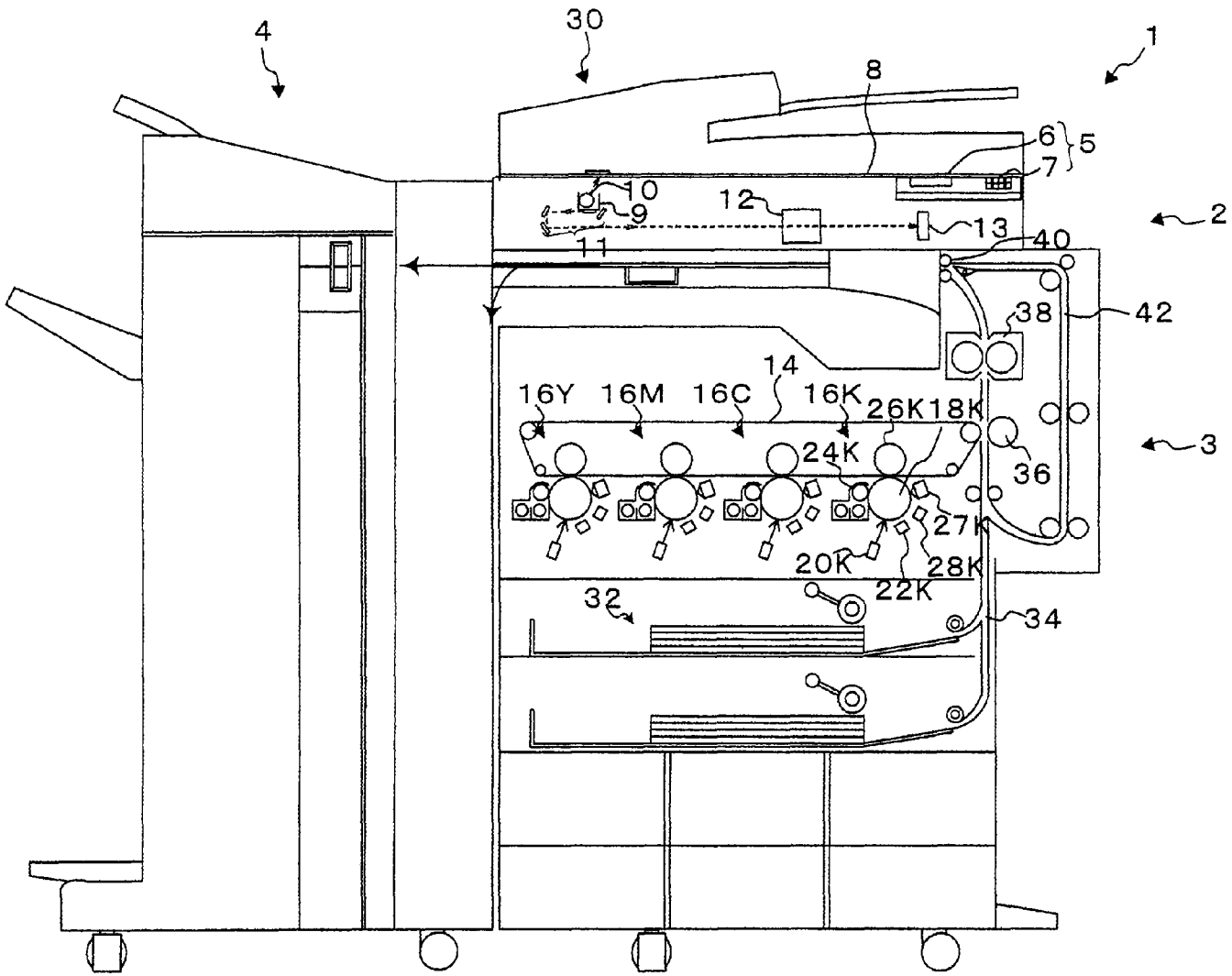
FIG. 1 is a schematic diagram of the image forming apparatus.

FIG. 1 is a schematic diagram of the image forming apparatus.

An image forming apparatus 1 includes a scanner 2 for reading an image to be read and a printer 3 for forming an image. The image forming apparatus 1 has an operation panel 5 including a display 6 of a touch panel type and various operation keys 7.

The operation keys 7 of the operation panel 5 include, for example, a ten-key pad, a reset key, a stop key, and a start key. To the display 6, for example, the sheet size, number of copies, print concentration setting, and various instructions of stapling and folding are input.

The scanner 2 includes a platen plate 8, a carriage 9, a lamp 10, a mirror 11, a lens 12 for converging reflected light, and a CCD 13 (Charge Coupled Device) which is a photoelectric conversion device for fetching the reflected light and converting it to an electric signal. Above the platen plate 8, an automatic document feeder 30 for conveying a document to a reading position is installed.

The printer 3 includes an intermediate transferring belt 14 as a transfer medium and four processing units 16Y, 16M, 16C, and 16K respectively corresponding to the colors of yellow (Y), magenta (M), cyan (C), and black (K) which are arranged side by side along the intermediate transferring belt 14.

The processing unit 16K includes a photoconductor 18K as an image carrier, a laser unit 20K for forming an electrostatic latent image on the photoconductor 18K, and a primary transferring device 26K, a cleaner 27K, and a charge elimination lamp 28K which are opposite to a photoconductive drum 8K across a charger 22K, a developing device 24K, and the intermediate transferring belt 14 which are arranged sequentially around the photoconductor 18K. The processing units 16Y, 16M, and 16C have a similar constitution to that of the processing unit 16K aforementioned. Hereinafter, the processing unit 16K of black (K) will be referred to and explained.

Firstly, a document is loaded at the reading position of the platen plate 8 or the automatic document feeder 30 conveys a document to the reading position. Then, the lamp 10 supported by the carriage 9 emits light to the document from the underneath of the platen plate 8. The reflected light from the document is induced to the lens 12 by the mirror 11. An image of the reflected light from the document is projected to the CCD 13 by the lens 12. The CCD 13 fetches the reflected light and outputs the image information of the document as an analog signal. The electric signal transmitted from the CCD 13 is converted to a digital signal. The laser unit 20K transmits the image-processed digital signal.

If the image formation is started by the printer 3, the charger 22K charges the outer peripheral surface of the rotating photoconductor 18K. Onto the outer peripheral surface of the photoconductor 18K charged at a uniform potential in the axial direction by the charger 22K, to form an electrostatic latent image, according to the image-processed digital signal, the laser unit 20K irradiates a laser beam. The developing device 24K gives a black developer (for example, toner) to the outer peripheral surface of the photoconductor 18K and develops the electrostatic latent image is to a toner (K) image.

The primary transferring device 26K transfers electrostatically the toner (K) image to the intermediate transferring belt 14.

The toner remaining on the photoconductor 18K without transferred is removed by the cleaner 27K positioned more on the downstream side of the photoconductor 18K in the rotational direction than the primary transferring device 26K. The residual electric charge on the outer peripheral surface of the photoconductor 18K is removed by the charge elimination lamp 28K positioned more on the downstream side of the photoconductor 18K in the rotational direction than the cleaner 27K. When forming a color image, the aforementioned operation is performed similarly for the processing units 16Y, 16M, and 16C.

The toner image transferred onto the intermediate transferring belt 14 is transferred electrostatically onto a sheet conveyed by a sheet feeder 32 via a conveying path 34 by a secondary transferring device 36. The fixing device 38 fixes the toner image on the sheet. The sheet on which the toner image is fixed is conveyed toward a conveying roller 40.

When printing both sides of a sheet, the conveying roller 40 rotates reversely and conveys the sheet to a conveying path 42. Onto the opposite surface of the sheet conveyed onto the conveying path 42, the secondary transferring device 36 transfers the toner image. The fixing device 38 fixes the toner image onto the sheet.

The sheet on which the toner image is fixed is discharged to the sheet post-processing apparatus 4 by the conveying roller 40. The sheet is referred to as, for example, ordinary paper, heavy paper, thin paper, glossy paper, or an OHP sheet. The printer 3, in addition to the aforementioned system, may be an ink jet system.

Figure 2:
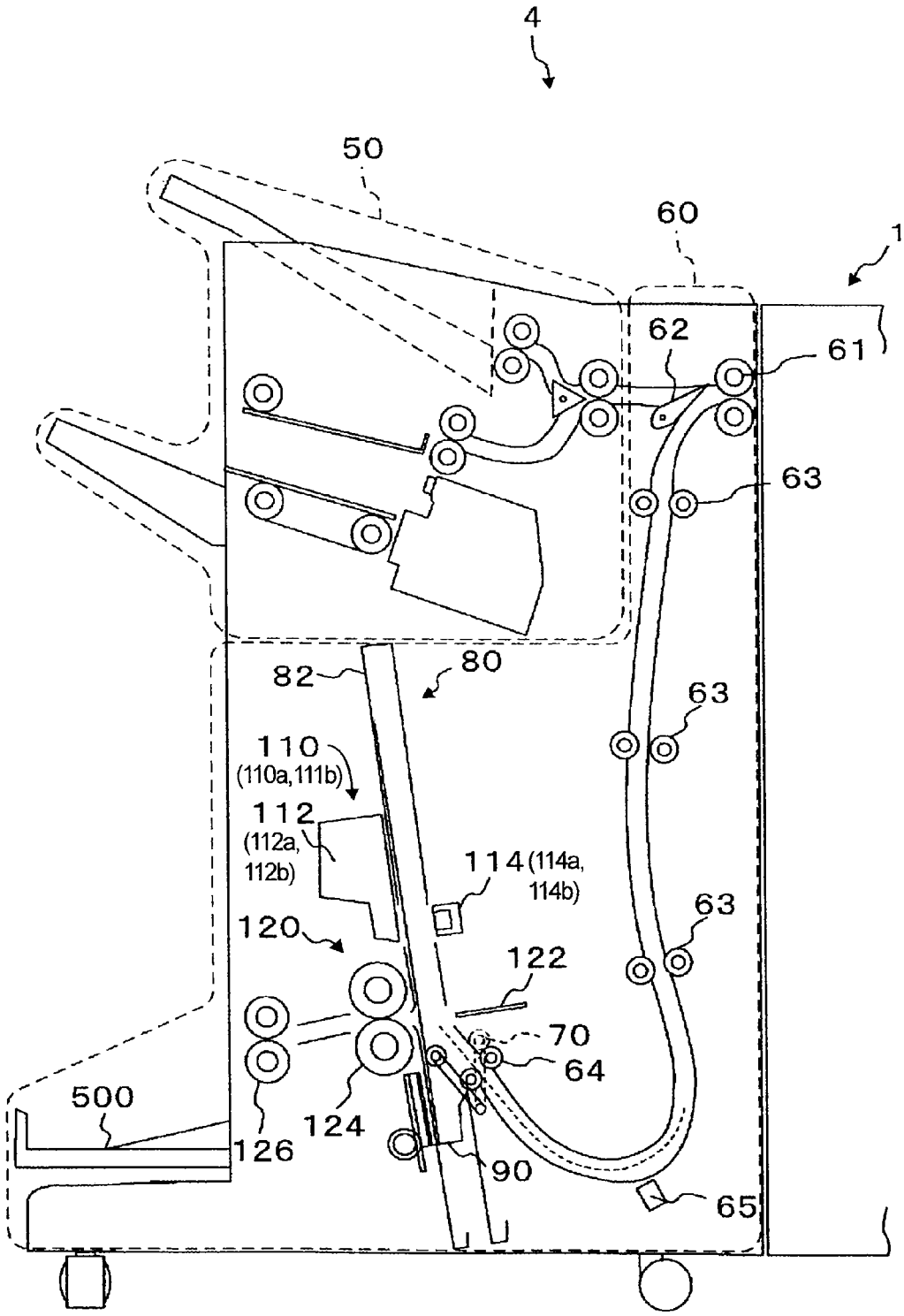
FIG. 2 is a schematic diagram of the sheet post-processing apparatus.

Next, the sheet post-processing apparatus 4 will be explained. FIG. 2 is a schematic diagram of the sheet post-processing apparatus.

The sheet post-processing apparatus 4 processes sheets discharged from the image forming apparatus 1 according to an input instruction from the operation panel 5 or an instruction from a PC (Personal Computer). The sheet post-processing apparatus 4 includes, for example, a finishing portion 50 for sorting a sheet bundle and stapling the end portion of the sheet bundle and a folding portion 60 for folding and stapling the sheet bundle. The finishing portion 50 may be, for example, the post-processing apparatus described in Japanese Patent Application Publication No. 2007-76862A.

The folding portion 60 includes conveying rollers 63 for conveying sheets, conveying rollers 64 and a conveying roller sensor 65 for conveying the sheets to a stack portion 80, an assisting member 70 for assisting stacking of the sheets, and the stack portion 80 for stacking temporarily the conveyed sheets in a standing position.

The stack portion 80 includes a stack tray 82 for stacking the surface of each sheet, a stacker unit 90 for receiving the rear end of each sheet in the conveying direction, a lateral alignment member 100 for laterally aligning a sheet bundle which will be described later, a stapler 110 for stapling the aligned sheet bundle, and a folding structure 120 for folding the stapled sheet bundle.

The folding portion 60 has a discharge tray 500 for receiving the post-processed sheets on the downstream side of the stack portion 80 in the sheet conveying direction.

Firstly, the flow of the sheet post processing will be explained briefly.

Entrance rollers 61 convey the sheets sent from the conveying roller 40 of the image forming apparatus 1 into the sheet post-processing apparatus 4. A branching member 62, when folding or stapling is instructed, guides sheets conveyed by the entrance rollers 61 into the folding portion 60. The sheets are conveyed by the conveying rollers 63 and are conveyed to the stack portion 80 by the conveying rollers 64.

In the stack portion 80, the stacker unit 90 receives the rear ends of the conveyed sheets in the conveying direction and the stack tray 82 supports the bottoms of the sheets. The stacker unit 90 supports the lower ends of the sheets stacked in a standing position and aligns the position of the end portion (lower end) of the sheets in the conveying direction. Hereinafter, in the stack portion 80, the rear end of each sheet in the conveying direction is described as a lower end of the sheet and inversely, the front end of each sheet in the conveying direction is described as an upper end of the sheet.

When the sheets are discharged into the stack portion 80, the assisting member 70 rotates in a position away from the sheets and contacts with the sheets. The assisting member 70 promotes the lower ends of the sheets to come to the stacker unit 90. The sheets stacked on the stack portion 80 are aligned also in the sheet width direction which is the direction crossing the sheet conveying direction. The alignment in the sheet width direction, hereinafter, is referred to as the lateral alignment. A constitution for executing the lateral alignment will be described later.

The stacker unit 90 moves up and down along the stack tray 82 and adjusts the sheet position stapled by the stapler 110 and the sheet position folded by the folding structure 120. In this embodiment, as an example, in the explanation, the central part of each sheet in the conveying direction is stapled or folded.

If the stacker unit 90 receives a series of sheets and a sheet bundle is formed, the stacker unit 90 moves so that the sheet stapled position comes to the stapling position by the stapler 110.

A plurality of (for example, two) staplers 110 are arranged side by side in the sheet width direction. The stapler 110 includes a stapler head 112 and an anvil 114. If the stacker unit 90 permits the sheet stapled position to stop at the stapling position by the stapler 110, the stapler head 112 and anvil 114 staple the sheets. The stacker unit 90, to receive the sheets, may stand by at the position where the central part of the sheets comes to the stapling position by the stapler 110.

When the stapler 110 staples the sheet bundle, the stacker unit 90 moves so that the sheet stapled position comes to the folding position by the folding structure 120. If the stacker unit 90 stops, the folding structure 120 starts folding.

The folding structure 120 includes a folding plate 122 and a folding roller pair 124. The folding plate 122 stands by at a position free of obstruction of sheet conveyance. The folding plate 122, to fold the sheets, moves toward the folding roller pair 124. The folding plate 122 presses the sheets and pushes them toward the nip portion of the folding roller pair 124. The folding roller pair 124 conveys the sheets pushed by the folding plate 122 under pressure and folds them.

A discharge roller 126 discharges the sheet bundle folded by the folding structure 120 to a discharge tray 500.

Figure 3:
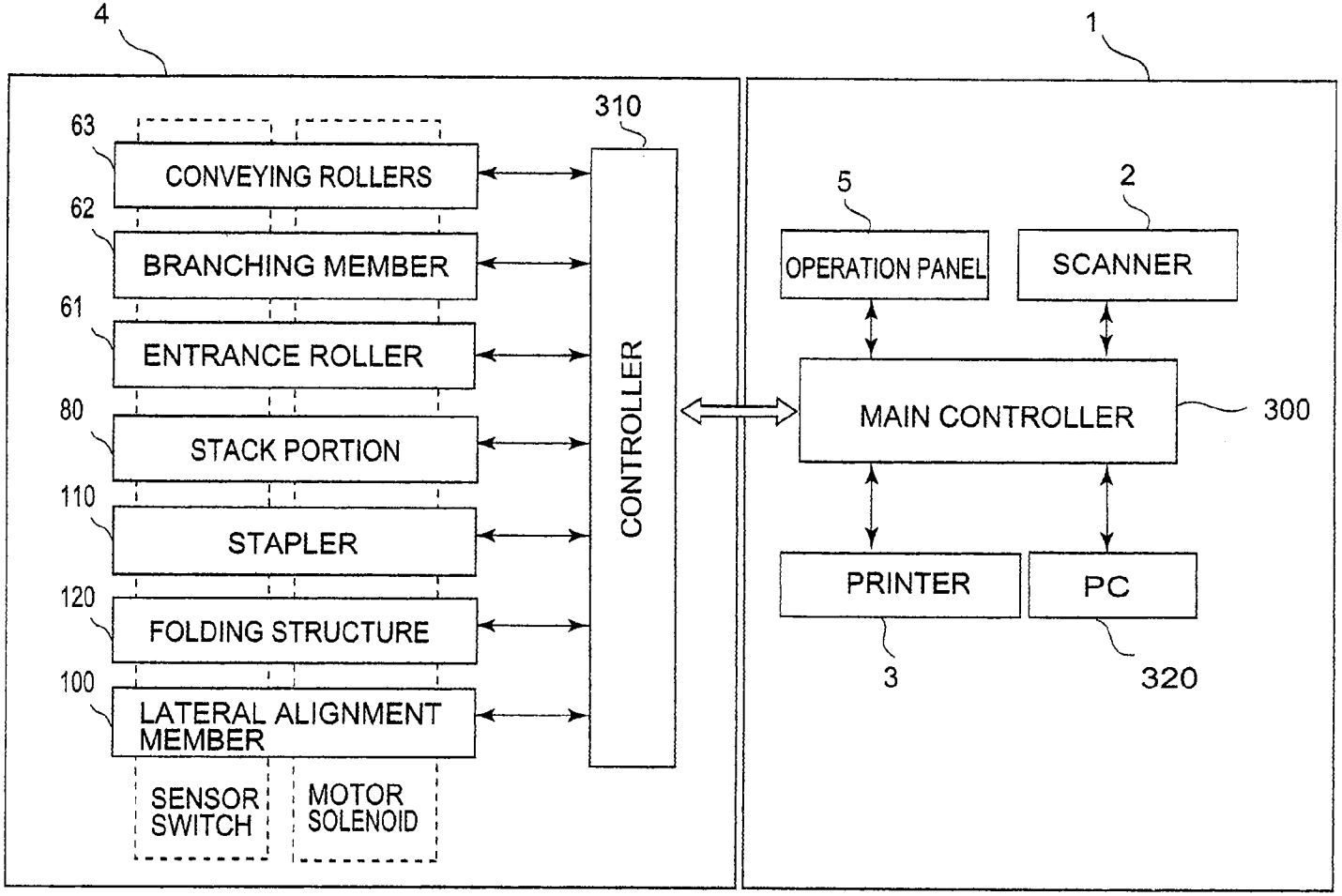
FIG. 3 is a schematic block diagram of the control system for the image forming apparatus and sheet post-processing apparatus.

Next, the control system for the image forming apparatus and sheet post-processing apparatus will be explained briefly. FIG. 3 is a schematic block diagram of the control system for the image forming apparatus and sheet post-processing apparatus.

The image forming apparatus 1 has a main controller 300. The main controller 300 synthetically controls a controller 310 for the scanner 2, printer 3, operation panel 5, and sheet post-processing apparatus 4. The main controller 300 furthermore corrects, compresses, or expands image data. The main controller 300 furthermore stores the compressed image data and print data. The main controller 300 furthermore communicates with a PC (Personal Computer) 320 outside the image forming apparatus 1.

The controller 310 for the sheet post-processing apparatus 4, on the basis of an instruction from the main controller 300, controls the operations of the entrance rollers 61, branching member 62, conveying rollers 63, assisting member 70, stacker unit 90, stapler 110, folding structure 120, and lateral alignment member 100.

Figure 5:
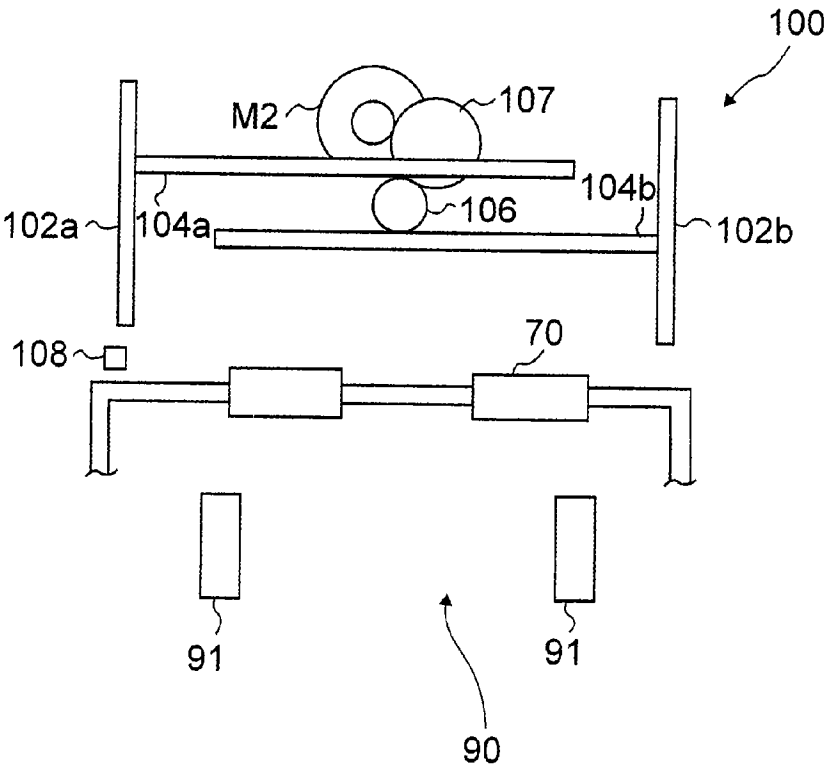
FIG. 5 is a schematic diagram viewed in the direction of the arrow A shown in FIG. 4 for explaining the lateral alignment member.
Figure 4:
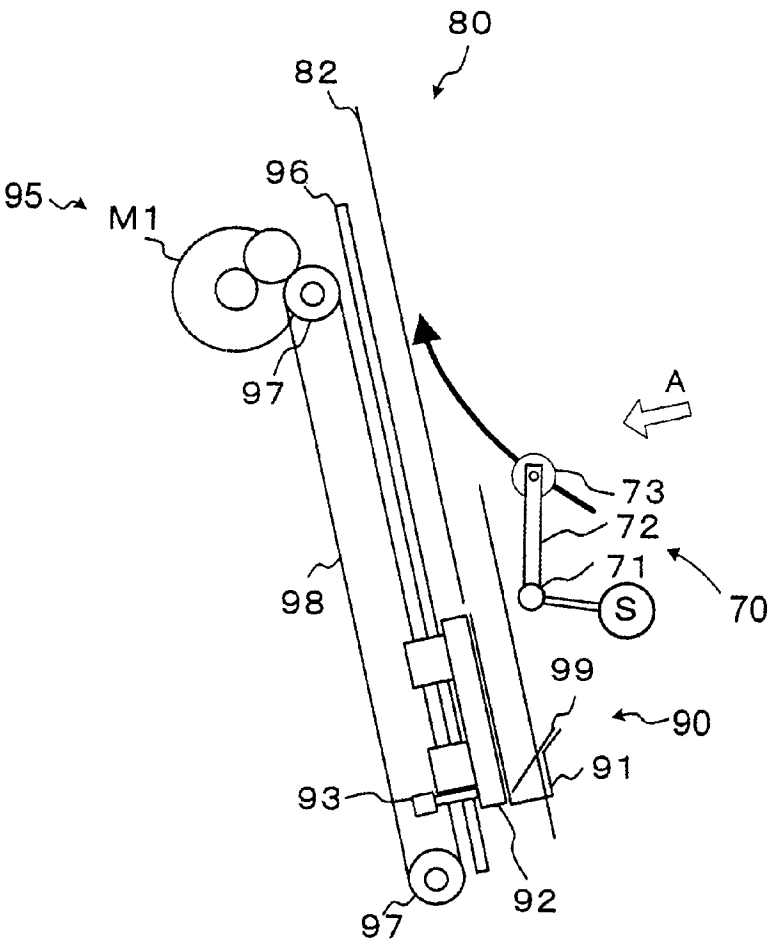
FIG. 4 is a schematic diagram for explaining the stacker unit.

FIG. 4 is a schematic diagram for explaining the stacker unit 90. FIG. 5 is a schematic diagram for explaining the lateral alignment member 100, which is viewed in the direction of the arrow A shown in FIG. 4.

As shown in FIG. 4, the stacker unit 90 includes a stacker arm 91, a stacker chassis 92, and a driver 95. The stacker arm 91 receives the lower end of each sheet. The stacker chassis 92 supports the stacker arm 91. The driver 95 moves up and down the stacker chassis 92. The driver 95 includes a rail 96, pulleys 97, a belt 98, and a motor M1. The rail 96 guides the stacker chassis 92 vertically in the sheet conveying direction. The belt 98 is suspended over the pulleys 97. The belt 98 is connected to the stacker chassis 92. The motor M1 rotates the belt 98 via the pulleys 97. The belt 98 moves the stacker chassis 92. The motor M1 may be a stepping motor.

A first detector 93 detects the position of the stacker arm 91. The first detector 93, for example, may be a micro-sensor or a micro-actuator. In this embodiment, the first detector 93 detects the home position (hereinafter, referred to as the first HP) of the stacker chassis 92. The vertical movement of the stacker arm 91 is driven on the basis of the first HP, so that it is controlled by the pulse number given to the motor M1. As an example, in this embodiment, the stacker arm 91 waits for the conveyed sheets at the position (the standby position of the stacker arm 91) where the central part of the sheets received in the vertical direction comes to the stapling position. The stacker arm 91 has a sheet lower end detector 99 for detecting arrival of the lower ends of the sheets. The sheet lower end detector 99, for example, may be a micro-processor or a micro-actuator.

The assisting member 70 includes a shaft 71, an arm 72, and an assist roller 73. The shaft 71 supports the arm 72. The arm 72 supports rotatably the assist roller 73 at its leading edge. The assisting member 70 rotates at a fulcrum of the shaft 71. For example, a solenoid S rotates the shaft 71. In this embodiment, the solenoid S rotates the assisting member 70. The assist roller 73 contacts with sheets discharged onto the stack portion 80. The assist roller 73 rotates so as to make the lower ends of the sheets collide with the stacker unit 90.

As shown in FIG. 5, the stack portion 80 has a lateral alignment member 100 above the stacker unit 90. The lateral alignment member 100 includes alignment members 102*a* and 102*b*, bridging members 104*a* and 104*b*, a pinion gear 106, and a motor M2. The alignment members 102*a* and 102*b* are opposite to and in parallel with each other and align the end portion of the sheets stacked on the stacker unit 90 in the width direction.

The bridging members 104*a* and 104*b* are connected respectively to the alignment members 102*a* and 102*b*. The bridging members 104*a* and 104*b* are opposite to and in parallel with each other. The bridging members 104*a* and 104*b* respectively have a rack on the opposite surfaces. The pinion gear 106 is fit simultaneously into the respective racks of the bridging members 104*a* and 104*b*. The motor M2 rotates the pinion gear 106 via a gear 107. The pinion gear 106 rotates so as to make the bridging members 104*a* and 104*b* slide mutually inversely in the sheet width direction. The motor M2, for example, may be a stepping motor. The positions of the alignment members 102*a* and 102*b* in the sheet width direction are detected by a second detector 108. The second detector 108, for example, may be a micro-sensor or a micro-actuator. In this embodiment, the second detector 108 detects that the alignment members 102*a* and 102*b* are in the state (the home position, hereinafter, referred to as the second HP) that they are opened in the width direction. The positions of the alignment members 102*a* and 102*b*, to drive on the basis of the second HP, are controlled by the pulse number given to the motor M2. If a stapling instruction is input from the operation panel 5 or the PC 320, after the lateral alignment member 100 aligns laterally the sheets, the stapler head 112 and anvil 114 of the stapler 110 staple the sheet bundle.

Figure 6A:
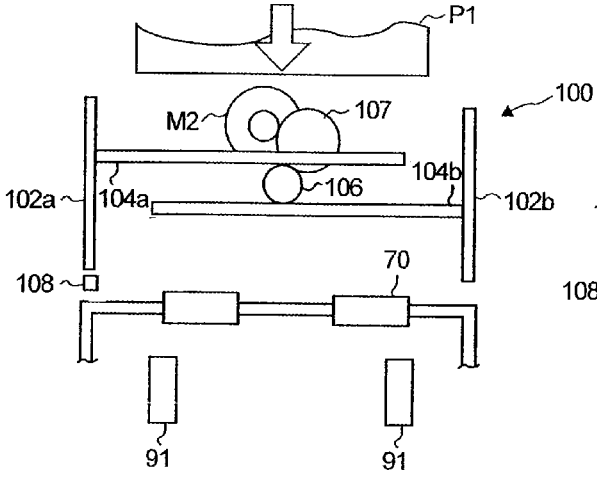
FIGS. 6A to 6D are schematic diagrams for explaining the operation of the lateral alignment member.

Next, the operation of the lateral alignment member 100 will be explained by referring to FIGS. 6A to 6D. FIG. 6A shows the status that the alignment members 102*a* and 102*b* are at the first position. If sheets are conveyed when the center of the interval between the alignment members 102*a* and 102*b* coincides with the center of sheets P1 conveyed in the width direction, it is an ideal conveying posture. The alignment members 102*a* and 102*b* stand by respectively at the first position away from the lateral ends of the sheets P1 conveyed in the ideal conveying posture by the first distance. The first distance, for example, may be 15 mm. The first position may be the second HP. The first position may be the position where the motor M2 is rotated at the predetermined pulse number given, thus the alignment members 102*a* and 102*b* move from the second HP.

Figure 6B:
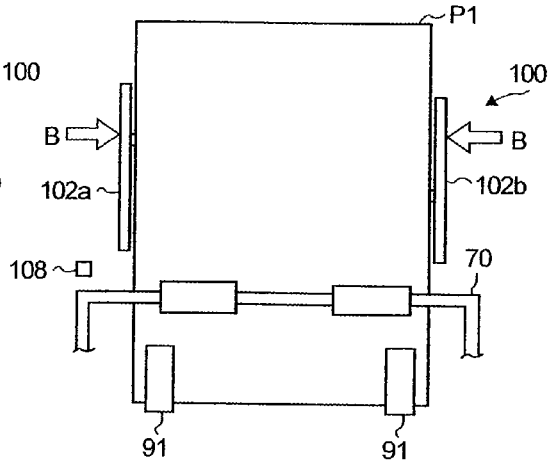

The alignment members 102*a* and 102*b*, so as to approach the lateral ends of the sheets P1 conveyed, move in the direction of the arrow B shown in FIG. 6B and align laterally the sheet P1. The alignment members 102*a* and 102*b*, for example, after the lower ends of the sheet P1 reach between the alignment members 102*a* and 102*b*, move so as to approach the lateral ends of the sheets P1. The alignment members 102*a* and 102*b*, for the lateral alignment, for example, move to the second position where the distance between the alignment members 102*a* and 102*b* is equal to the sheet length (the second distance) in the width direction.

Figure 6C:
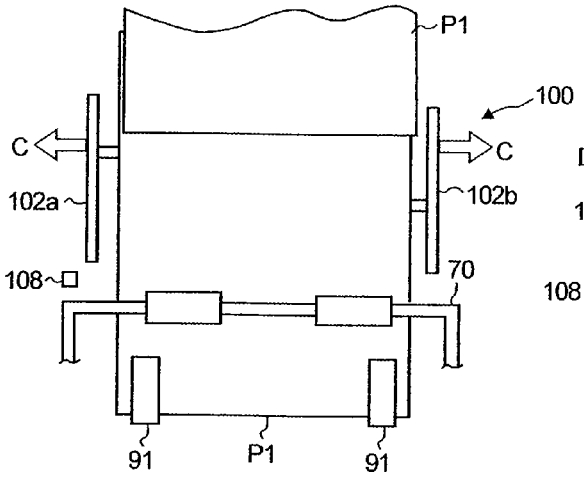

After the lateral alignment, as shown by the arrow C in FIG. 6C, the alignment members 102*a* and 102*b* move to the third position away from the lateral ends of the sheets by the third distance. The alignment members 102*a* and 102*b* wait for the succeeding sheets P2 at the third position. The third distance may be shorter than the first distance. The third distance may be, for example, 3 mm.

Figure 6D:
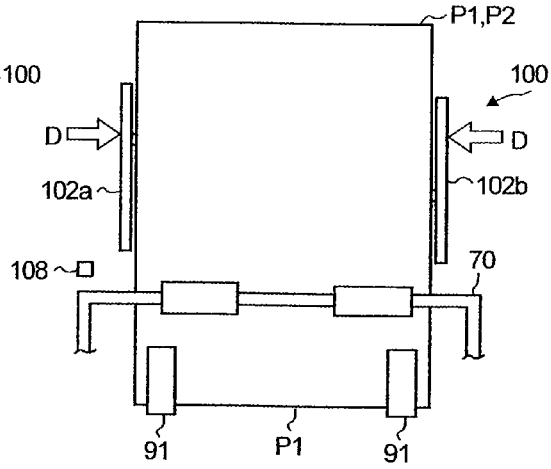

The alignment members 102*a* and 102*b*, so as to approach the lateral ends of the sheets P2 conveyed, move in the direction of the arrow D shown in FIG. 6D and align laterally the sheet bundle including the sheets P1 and sheets P2. The alignment members 102*a* and 102*b*, for example, after the lower ends of the sheet P2 reach between the alignment members 102*a* and 102*b*, move so as to approach the lateral ends of the sheets P2. The alignment members 102*a* and 102*b*, for the lateral alignment, for example, move to the second position. The lateral alignment member 100 repeats the aforementioned operation whenever sheets are conveyed and aligns laterally a sheet bundle including the sheets P1 and P2 and the succeeding sheets.

Embodiment 1 of the Lateral Alignment Operation

Figure 7:
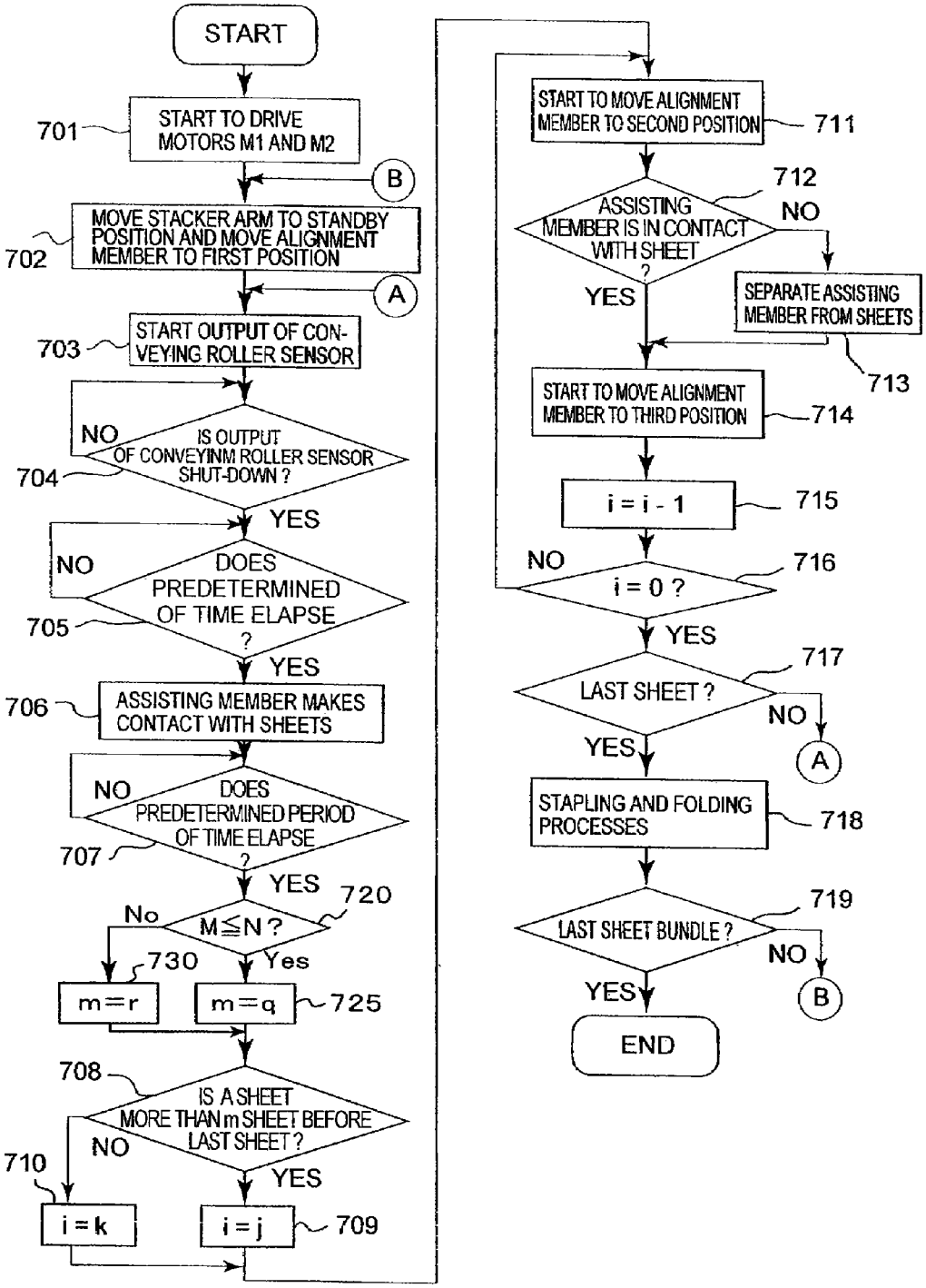
FIG. 7 is a flow chart for explaining the operation of the lateral alignment member.
Figure 8:
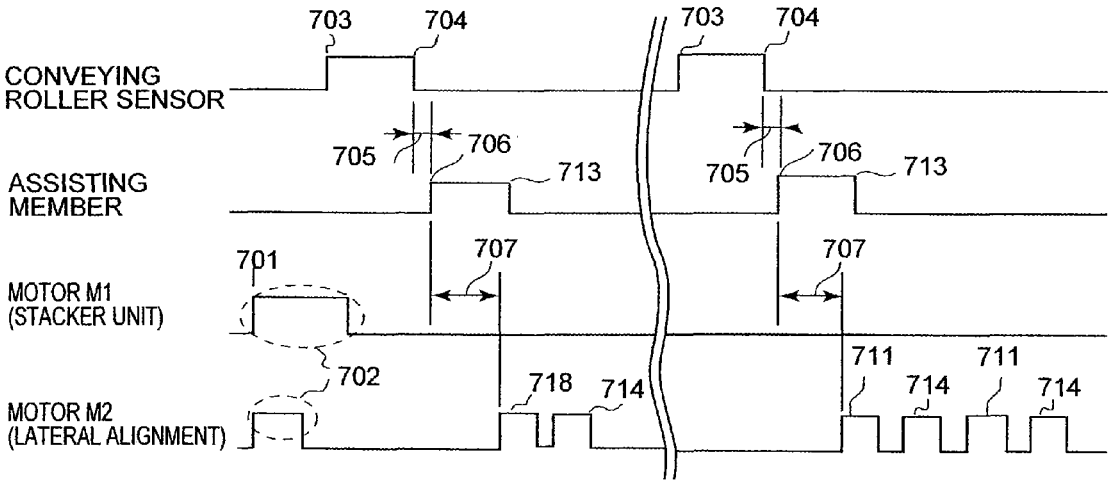
FIG. 8 is a timing chart showing the operation of each member corresponding to the flow chart shown in FIG. 7.

By referring to FIGS. 7 and 8, the operation timing of the lateral alignment member 100 will be explained. FIG. 7 is a flow chart of the operation of the lateral alignment member 100 and FIG. 8 is a timing chart of each member corresponding to the flow chart shown in FIG. 7.

By the operation keys 7, if an instruction of the number of sheets of a sheet bundle and stapling and folding is input and the start key is pressed, the main controller 300 of the image forming apparatus 1 permits the main controller 310, at 701, to start driving the motors M1 and M2. At 702, the stacker arm 91 moves to the standby position of the stacker arm 91. The alignment members 102*a* and 102*b* move to the first position. If the stacker arm 91 is already at the standby position of the stacker arm 91, at 701, the motor M1 does not operate and the stacker arm 91 does not move and waits for sheets. If the alignment members 102*a* and 102*b* are already at the first position, at 701, the motor M2 does not operate and the alignment members 102*a* and 102*b* do not move and wait for sheets.

At 703, the conveying roller sensor 65, when detecting the leading edge of the sheet conveyed by the conveying rollers 63, raises the output from the low level to the high level. Then, the conveying roller sensor 65, when detecting the rear end of the sheet, at 704, lowers the output from the high level to the low level.

In the controller 310, after a predetermined period of time elapses at 705 after the output of the conveying roller sensor 65 is lowered, the assisting member 70, at 706, contacts with the sheet. The predetermined period of time may be preset so that the assist roller 73 contacts with the sheet conveyed. The controller 310, after the output of the conveying roller sensor 65 is raised and then a preset pulse number is given to the drive motor of the conveying roller 63, permits the assisting member 70 to contact with the sheet.

At 707, the controller 310 waits for a lapse of a predetermined period of time after the assisting member 70 contacts with the sheet. The predetermined period of time may be the time from making contact with the sheet by the assisting member 70 until giving a predetermined pulse number to the drive motor of the conveying roller.

At 720, the controller 310 determines that a value M is smaller than a value N. The value M may be an integer bigger than or equal to 2. The value N may be a number of sheets included in the sheet bundle. If the value M is smaller than the value N (Yes at 720), a value q is assigned to a variable m at 725. The value q is an integer smaller than the value M. The value q may be calculated from the value M. The value q may be an half of the value M. The value q may be a one third of the value M. If the value M is not smaller than the value N (No at 720), a value r is assigned to a variable m at 730. The value r is an integer smaller than the value q.

At 708, the controller 310 determines whether the sheet is more than m sheets before the last sheet of the sheet bundle or not. The value m may be preset. If the sheet is more than m sheets before the last sheet of the sheet bundle (Yes at 708), the controller 310 assigns a value j for a variable i at 709. If the sheet is not more than m sheets before the last sheet of the sheet bundle (No at 708), the controller 310 assigns a value k for the variable i at 710. The value k is an integer of 2 or larger which is larger than j. The value k may be preset. The value k may be set by a user. The value M, r and q may be preset. The value M, r and q may be set by the user.

If the value M is 0, the controller 310 does not execute the act 730. The value q may be 0 because the value q is set smaller than or equal to the value M. At 708, the controller 310 determines whether the sheet is more than 0 sheets before the last sheet of the sheet bundle or not. That is, the controller 310 determines whether the sheet is the last sheet of the sheet bundle or not at 708.

If the value M is 2, the value q is 2, the value r is 0 and the sheet bundle includes up to 2 sheets (N=2, 1), 0 as the value r is assigned to the variable m at 725. At 708, the controller 310 determines whether the sheet is more than 0 sheets before the last sheet of the sheet bundle or not. That is, the controller 310 determines whether the sheet is the last sheet of the sheet bundle or not at 708.

If the value M is 2, the value q is 2, the value r is 0 and the sheet bundle includes more than 2 sheets (N=3, 4, 5 or more), 2 as the value q is assigned to the variable m at 730. At 708, the controller 310 determines whether the sheet is more than 2 sheets before the last sheet of the sheet bundle or not. If the vale N is 3, the lateral alignment is executed k times for each time each of three sheets included in the sheet bundle arrives at the stacker 91. If the vale N is 4, the lateral alignment is executed j times upon a first sheet of the sheet bundle arriving at the stacker 91, and the lateral alignment is executed k times for each time each of following three sheets included in the sheet bundle arrives at the stacker 91.

At 711, an alignment member 102, for lateral alignment of the sheets, begins to move from the first position to the second position. Namely, it begins to give a pulse.

At 712, the controller 310 confirms whether the assisting member 70 is in contact with the sheet or not. The controller 310, if the assisting member 70 is in contact with the sheet, at 713, after the predetermined period of time elapses after starting to give the pulse to the motor M2 at 711, separates the assisting member 70 from the sheet. In this embodiment, at 711, before the alignment member 102 reaches the second position after it starts to move, the controller 310 may separate the assisting member 70 from the sheet. When the assisting member 70 is separated from the sheet, the alignment member 102 performs the lateral alignment. Namely, the predetermined period of time may be shorter than the time required for the alignment member 102 to arrival at the second position after movement start. Further, the arrival of the alignment member 102 at the second position may be simultaneous with the separation of the assisting member 70 from the sheet. The separation of the assisting member 70 from the sheet may be later than the arrival of the alignment member 102 at the second position.

The controller 310, after the lateral alignment, at 714, permits the alignment members 102 to start to move from the second position to the third position. At 715, the controller 310 subtracts 1 from the variable i. At 716, the controller 310 confirms whether the variable i is 0 or not. If the variable i is not 0 (No at 716), to execute again the lateral alignment, the controller 310 returns to 711.

If the variable i is 0 (Yes at 716), the controller 310, at 717, determines whether the succeeding sheet is the last sheet of the sheet bundle or not. At 717, if the succeeding sheet is not the last sheet of the sheet bundle (No at 717), the controller 310 returns to 703. The alignment member 102 is stopped at the third position. On the other hand, at 717, if the succeeding sheet is the last sheet of the sheet bundle (Yes at 717), at 718, the stapler 110 staples the sheet bundle and the folding structure 120 folds the sheet bundle. The sheet bundle is discharged to the discharge tray 500.

After stapling and folding, at 719, the controller 310 confirms whether before the start key is pressed, the sheet bundle of the number of sheets input by the operation keys 7 is folded or not. If the controller 310 determines that the sheet bundle of the number of sheets input is all folded (No at 719), the alignment member 102 moves to the first position at 702 without stopping at the third position. On the other hand, if the controller 310 determines that the sheet bundle of the number of sheets input is all folded (Yes at 719), the controller 310 finishes the operation at the stack portion 80. The determination of whether the sheet bundle of the input number of sheets is folded or not is not limited to after stapling and folding and it may be made before the stapling and folding of the last bundle are completed after the start key is pressed by the operation keys 7.

Further, a trigger of the operation of each unit is not limited to the lowering of the output of the conveying roller sensor 65. For example, the rising of the output of the conveying roller sensor 65 may be a trigger. The contact with or separation from the sheet of the assisting member 70 may be a trigger. The output of a sheet lower end detector may be a trigger. The controller 310, to generate a trigger, may have a timer for measuring the time. The time relationship between the start of the operation of each unit and the trigger may be preset by calculation and experimentation for sheet size and may be stored in the memory of the controller 310.

The standby position of the stacker arm 91 varies with the sheet size specified by the image forming apparatus 1. Therefore, from 706 to 709, the time for the assisting member 70 from making contact with the sheet to separation from it may be set in accordance with the sheet size.

When conveying the first sheet to the stack portion 80, at 704 shown in FIG. 7, it is possible to detect the rear end of the sheet by the conveying roller sensor 65 and then decelerate the conveying speed. For example, the first sheet of the sheet bundle is conveyed to the stack tray 82 where not sheet is placed yet. The friction between the stack tray 82 and the sheet is small. If the conveying speed of the first sheet is decelerated, the sheet conveyed from the conveying rollers 64 can be prevented from excessively jumping above the stack tray 82. For the second and subsequent sheets, since the sheets are stacked already on the stack tray 82 and the friction between the sheets is large, the conveying speed may not be decelerated.

The number of times of lateral alignments may be increased as the number of sheets is increased. For example, when the sheet two sheets before the last sheet is stacked on the stacker arm 91, the lateral alignment may be executed two times and when the last sheet is stacked on the stacker arm 91, the lateral alignment may be executed three times.

As mentioned above, the lateral alignment is executed a plurality of times when the last sheet is stacked, thus all the sheets are always aligned laterally a plurality of times. After the lateral alignment of the last sheet is finished, the sheets are stapled and folded. Even if the lateral alignment is executed for the last sheet a plurality of times, the image forming apparatus 1 does not need to wait for discharge of the sheets. For example, if the lateral alignment is executed two times only when the last sheet is stacked, the influence of delay can be minimized inasmuch as is possible and the sheet bundle can be aligned appropriately.

When the sheets other than the last sheet are stacked on the stacker arm, the lateral alignment may be executed a plurality of times. The number of times of alignments (the second number of times) for the last sheet stacked on the stacker arm 91 may be made larger than the number of times of alignments (the first number of times) executed for the sheets stacked on the stacker arm 91 before the last sheet. The second position may be varied with the number of times of lateral alignments. For example, assuming k=3, if 711 to 716 are executed, it is possible to set the distance between the alignment members 102*a* and 102*b* at the second position in the case of i=3 to the second distance, the distance between the alignment members 102*a* and 102*b* at the second position in the case of i=2 to the fourth distance which is longer than the second distance and shorter than the third distance, and the distance between the alignment members 102*a* and 102*b* at the second position in the case of i=1 to the fifth distance which is shorter than the second distance. For example, assuming k=3, if 711 to 716 are executed, it is possible to set the distance between the alignment members 102*a* and 102*b* at the second position in the case of i=3 to the fourth distance, the distance between the alignment members 102*a* and 102*b* at the second position in the case of i=2 to the fifth distance, and the distance between the alignment members 102*a* and 102*b* at the second position in the case of i=1 to the second distance.

(A modification of the lateral alignment operation) The controller 310 may determine whether the sheet is later than m th sheet counted from the last sheet of the sheet bundle at 708. The value M and the value q may be bigger than 0 at this situation. The value M may be bigger than 1 at this situation.

If the value M is 2, the value q is 2, the value r is 0 and the sheet bundle includes up to 2 sheets (N=2, 1), 0 as the value r is assigned to the variable m at 725. At 708, the controller 310 determine whether the sheet is later than 0th sheet counted from the last sheet of the sheet bundle. That is, the controller 310 determines whether the sheet arrives at the stacker 91 later than the last sheet of the sheet bundle or not. The controller 310 determines that all sheets included in the sheet bundle are later than 0th sheet counted from the last sheet of the sheet bundle. Therefore, the controller 310 executes the act 710 for all sheets included in the sheet bundle.

If the value M is 2, the value q is 2, the value r is 0 and the sheet bundle includes more than 2 sheets (N=3, 4, 5 or more), 2 as the value q is assigned to the variable m at 730. At 708, the controller 310 determine whether the sheet is later than a second sheet counted from the last sheet of the sheet bundle.

If the vale N is 3, the lateral alignment is executed j times upon a first sheet of the sheet bundle arriving at the stacker 91, and the lateral alignment is executed k times for each time each of following two sheets included in the sheet bundle arrives at the stacker 91.

If the vale N is 4, the lateral alignment is executed j times upon a first sheet of the sheet bundle arriving at the stacker 91 and upon a first sheet of the sheet bundle arriving at the stacker 91. The lateral alignment is executed k times for each time each of following two sheets included in the sheet bundle arrives at the stacker 91.

The time required for lateral alignment can be saved by employing such modification if a total number of sheets included in a sheet bundle is small enough to be aligned easily.

Embodiment 1 of the Assisting Member and Holding Member

Figure 9:
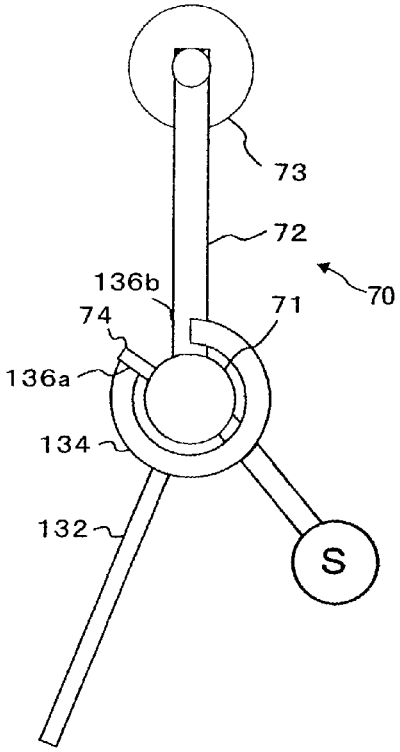
FIG. 9 is a schematic diagram for explaining the assisting member and holding member.
Figure 10:
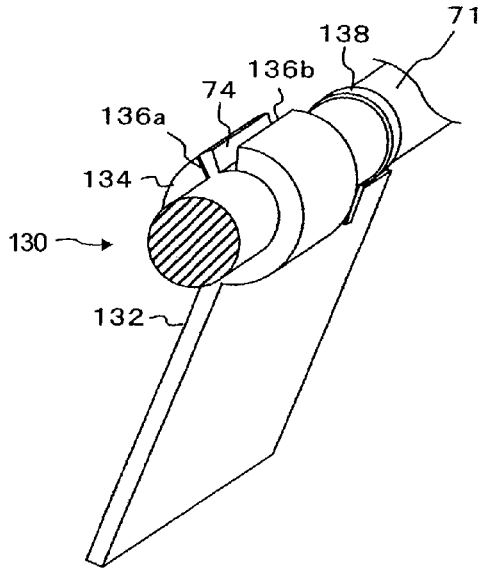
FIG. 10 is a schematic perspective view for explaining the assisting member and holding member shown in FIG. 9.

The assisting member 70 and holding member 130 will be described. FIG. 9 is a cross sectional view of the assisting member 70 and holding member 130. FIG. 10 is a perspective view of the assisting member 70 and holding member 130.

A sheet bundle stacked on the stacker arm 91 in a standing position may be bent due to its own weight or the rotation of the assist roller 73. The alignment of sheets in the conveying direction when the original stapling position of the sheets is shifted due to the bending below the stack portion 80 is referred hereinafter to as the longitudinal alignment.

The assisting member 70 has the holding member 130 for holding the sheets to prevent them from bending.

The assisting member 70 includes the shaft 71, arm 72, and assist roller 73. The shaft 71 has a projection 74.

The holding member 130 includes a paddle 132 and an attaching portion 134. The paddle 132 contacts with the lower ends of the sheets stacked on the stacker arm 91. The paddle 132 is connected to the attaching portion 134. The shaft 71 supports the attaching portion 134. The attaching portion 134 rotates round the shaft 71. The attaching portion 134 has a slot inserted into the shaft 71. A spring (an elastic member) 138 such as a winding spring or a spring presses the paddle 132 to the stack tray 82.

The attaching portion 134 has a first end face 136*a* for making contact with the projection 74 at one end of the circular arc of the slot. The attaching portion 134 has a second end face 136*b* at the other end of the circular arc of the slot. The distance between the first end face 136*a* and the second end face 136*b* is shorter than the diameter of the shaft 71. The first end face 136*a* and second end face 136*b* are sufficiently away from each other so as to prevent simultaneous contact with the projection 74. The projection 74 is fixed to the shaft 71. The projection 74 moves between the first end face 136*a* and the second end face 136*b*. The holding member 130 is pressed by the spring 138, so that when the paddle 132 is not in contact with the sheets, the first end face 136*a* contacts with the projection 74. The projection 74 does not contact simultaneously with the first end face 136*a* and second end face 136*b*.

The operations of the assisting member 70 and holding member 130 will be explained. FIGS. 11A to 11D are cross sectional views of the assisting member 70 and holding member 130.

Figure 11A:
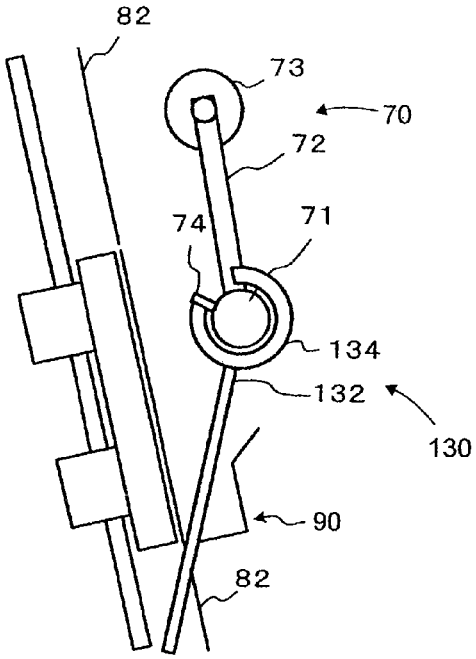
FIGS. 11A to 11D are schematic diagrams for explaining the operations of the assisting member and holding member.

As shown in FIG. 11A, the assisting member 70 is at the position (the standby position of the assisting member 70) separated from the stack tray 82 and sheets. The holding member 130 is pressed by the spring 138 toward the stack tray 82. The holding member 130, since the first end face 136*a* contacts with the projection 74, is at the stop position. The stop position may be the position where the lower end of one sheet conveyed to the stack tray 82 is pressed to the stack tray 82. The stop position, in the plane that the axial direction of the shaft 71 is a normal line, may be the position where the stack tray 82 and holding member 130 cross each other.

Figure 11B:
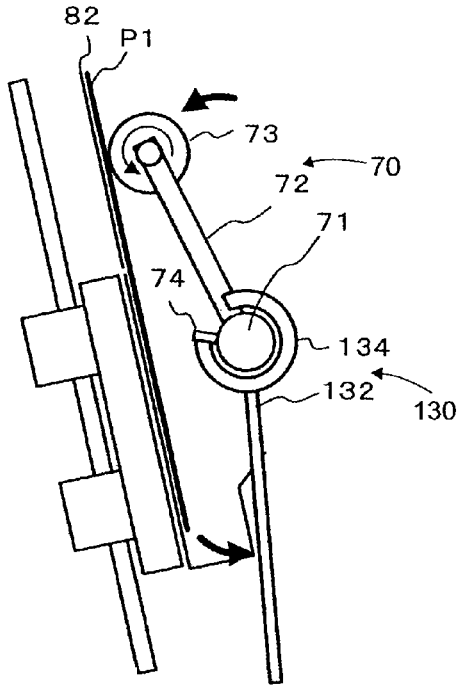

As shown in FIG. 11B, the assisting member 70, since the assist roller 73 contacts with the sheet P1 conveyed to the stack tray 82, rotates from the standby position.

The assisting member 70 rotates, thus the projection 74 presses the first end face 136*a*. The holding member 130 rotates so as to separate from the stack tray 82 round the shaft 71. The holding member 130 moves to the position free of interference with the sheet P1 stacked on the stack tray 82 in connection with the rotation of the assisting member 70.

Figure 11C:
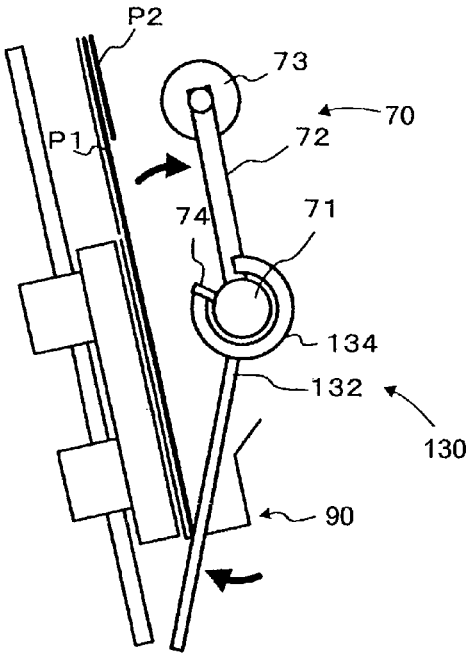

After the sheet P1 is stacked on the stack tray 82, as shown in FIG. 11C, the assisting member 70, to return to the standby position, rotates so as to separate from the stack tray 82 and sheet P1.

On the other hand, the holding member 130 pressed by the spring 138, to eliminate the bending of the sheet P1, presses the lower end of the sheet P1 to the stack tray 82.

Figure 11D:
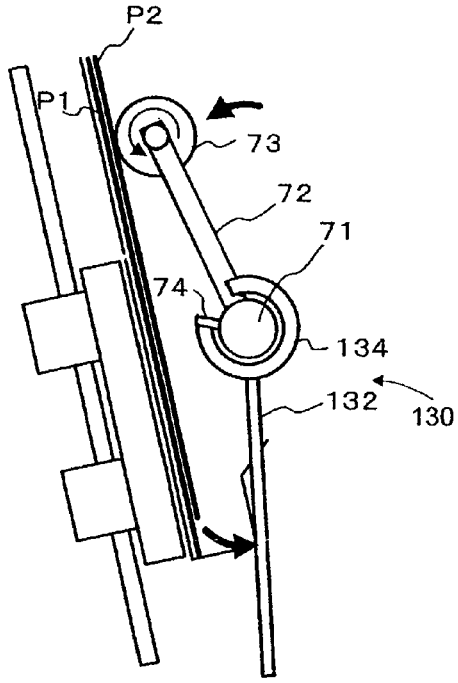

As shown in FIG. 11D, the assisting member 70, to permit the assist roller 73 to contact with the sheet P2 conveyed to the stack tray 82, rotates from the standby position. The assist roller 73 contacts with the sheet P2 with rotation.

When the assisting member 70 rotates from the standby position to permit the assist roller 73 to contact with the sheet P2, the lower end of the sheet P2 may be below the position where the assist roller 73 contacts with the sheet P2.

The assisting member 70 rotates, thus the projection 74 presses the first end face 136*a*. The holding member 130 rotates so as to separate from the stack tray 82 round the shaft 71. The holding member 130 moves to the position free of interference with the sheet P1 stacked on the stack tray 82 in connection with the rotation of the assisting member 70. The assisting member 70 and holding member 130 repeat the operations shown in FIGS. 13A to 13D until all the sheets of the sheet bundle are stacked on the stacker unit 90.

Figure 12:
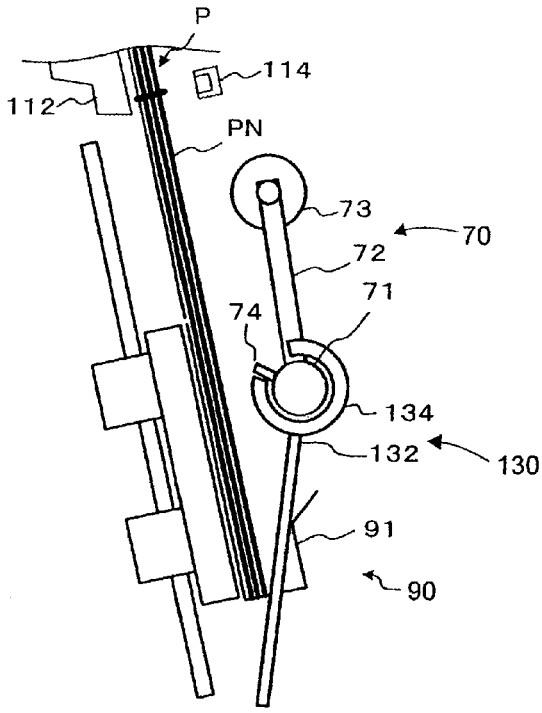
FIG. 12 is a schematic diagram for explaining the assisting member and holding member when stapling a sheet bundle.
Figure 13A:
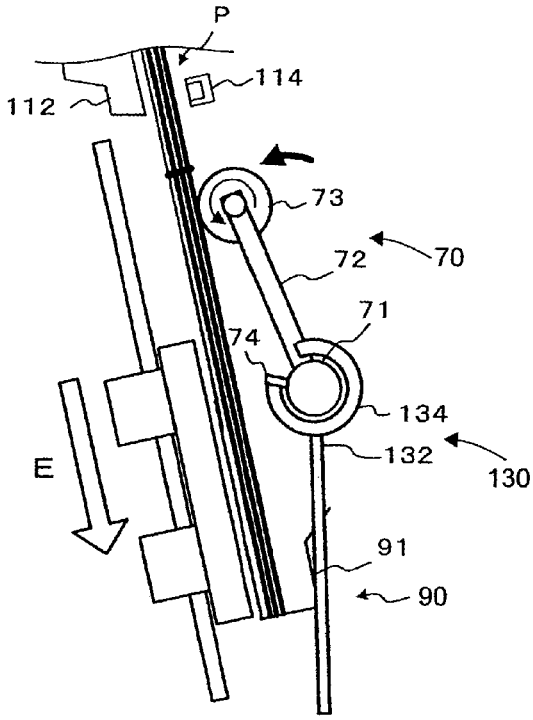
FIGS. 13A and 13B are schematic diagrams for explaining the operations of the assisting member and holding member when holding a sheet bundle.
Figure 13B:
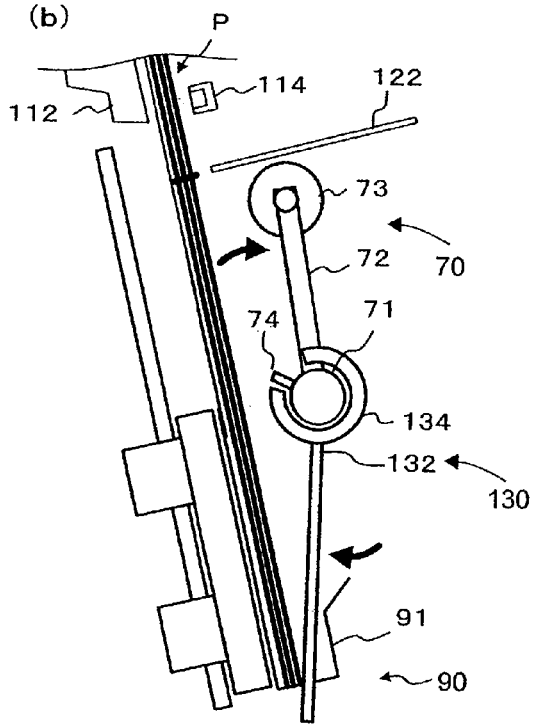

The assisting member 70 and holding member 130 when executing stapling and folding will be explained. FIG. 12 is a cross sectional view of the assisting member 70 and holding member 130 when stapling a sheet bundle. FIGS. 13A and 13B are cross sectional views of the assisting member 70 and holding member 130 when folding the sheet bundle.

As shown in FIG. 12, the assisting member 70 rotates to the standby position to separate from all the sheets of the sheet bundle stacked on the stacker unit 90. The holding member 130 contacts with the lower end of the uppermost sheet PN of the sheet bundle P to press the sheet bundle P to the stack tray 82. When the bending of the sheet bundle P is eliminated, the stapler 110 staples the sheet bundle P. If the sheet bundle P is thick, the holding member 130 contacts with the sheet bundle P and stops without rotating to the stop position. On the other hand, the assisting member 70 rotates to the standby position, so that the projection 74 and the first end face 136*a* are separated from each other. Even if the holder member 130 is stopped without rotating to the stop position, the assisting member 70 rotates to the standby position. After the stapler head 112 and anvil 114 staple the sheet bundle P, as shown in FIG. 13A, the assisting member 70, to permit the assist roller 73 to contact with the sheet bundle P conveyed to the stack tray 82, rotates from the standby position. The stacker unit 90 moves so that the stapled position of the sheet bundle P comes to the folding position of the folding structure 120 located below the stapler 110. The stacker unit 90, as shown by the arrow E, moves downward along the stack tray 82. The sheet bundle P moves downward in correspondence with the movement of the stacker unit 90. The assist roller 73, to assist the descent of the sheet bundle P in correspondence with the descent of the stacker unit 90, contacts with the sheet bundle P by rotating.

If the stapled position of the sheet bundle P comes to the folding position of the folding structure 120, as shown in FIG. 13B, the assisting member 70, to return to the standby position, rotates so as to separate from the stack tray 82 and sheet bundle P. On the other hand, the holding member 130, to push the sheet bundle P to the stack tray 82, contacts with the lower end of the sheet bundle P at the position closer to the leading edge side of the paddle 132 than the position where it contacts with the lower end of the sheet bundle P when the sheet bundle P is stapled by the stapler 110. The folding plate 122 and folding roller pair 124 of the folding structure 120 fold the sheet bundle P free of bending.

Embodiment 2 of the Assisting Member and Holding Member

Figure 15:
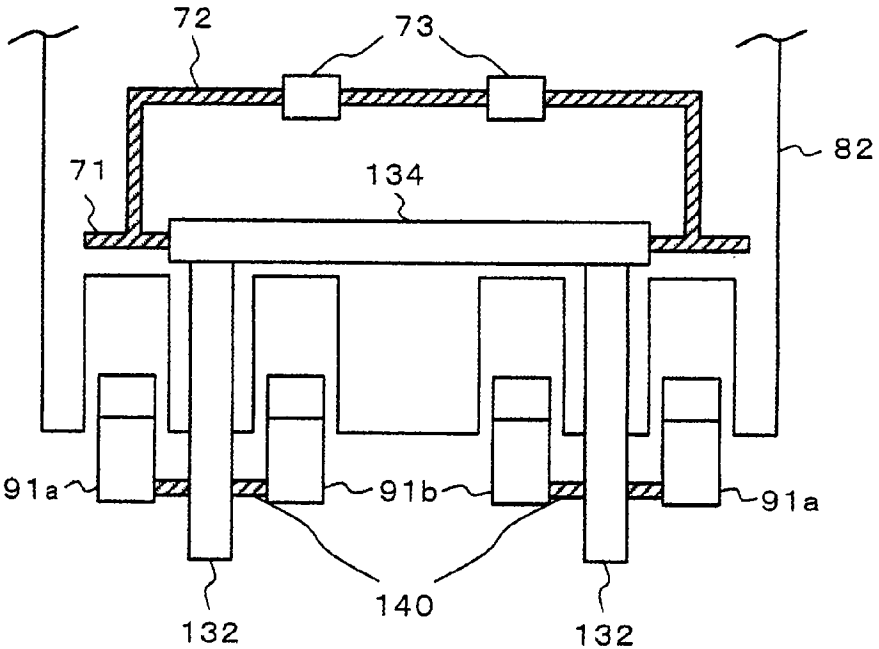
FIG. 15 is a schematic diagram viewed in the direction of the arrow F shown in FIG. 14 for explaining the stopper.
Figure 14:
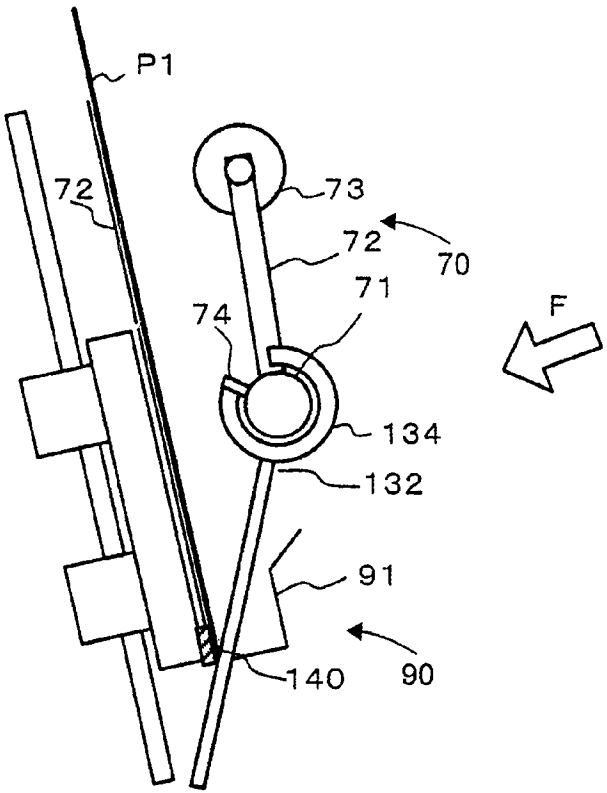
FIG. 14 is a schematic diagram for explaining the stopper.

FIG. 14 is a cross sectional view of a stopper 140, the assisting member 70, and the holding member 130. FIG. 15 is a drawing when FIG. 14 is viewed in the direction of the arrow F shown in FIG. 14.

The stopper 140 is suspended over a first stacker 91*a* and a second stacker 91*b* in the width direction of the sheets conveyed. The stopper 140 is installed in the position close to the stack tray 82 at the bottom of the stacker arm 91. The stopper 140 prevents the holding member 130 for pressing the lower end of the sheet P1 to the stack tray 82 from excessive rotation. If the holding member 130 rotates excessively, the paddle 132 bends the sheet P1 reversely or creases the lower end of the sheet P1. The stopper 140 prevents the holding member 130 from excessive rotation, so that the assisting member 70 can rotate so as to separate from the stack tray 82 rather than the standby position in line with the stop position.

The stopper 140 is not limited to the constitution that it is suspended between the first stacker 91*a* and the second stacker 91*b*. For example, it may be a projection attached to either of the first stacker 91*a* and second stacker 91*b*. Or, instead of the stopper 140, it is possible to make the stack tray 82 sufficiently long to prevent the holding member 130 from many times of rotations more than necessary.

Embodiment 3 of the Assisting Member and Holding Member

Figure 16:
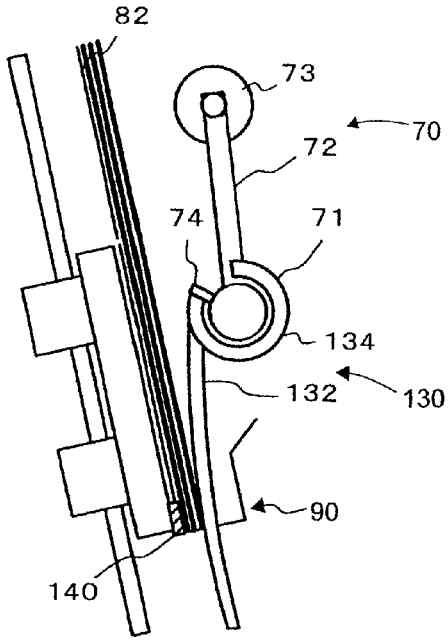
FIG. 16 is a schematic diagram for explaining another example of the assisting member and holding member.

FIG. 16 is a cross sectional view showing a flexible member such as rubber or plastics used for the paddle 132. The stack tray 82 instructs the sheet bundle P. The assisting member 70 is separated from the stack tray 82.

In this embodiment, if the assisting member 70 is separated from the stack tray 82 when the sheet bundle P is stacked on the stack tray 82, the holding member 130 pressed by the spring 138 presses the lower end of the uppermost sheet PN of the sheet bundle P stacked on the stack tray 82 to the stack tray 82. The flexible paddle 132 contacts with the sheet P1, thereby is warped and contacts with the PN stacked on the uppermost part of the sheet bundle P in a wide area. The paddle 132 contacts with the sheet bundle P and then is deformed in correspondence with the rotation of the holding member 130. The direction of the force applied to the lower end of the sheet bundle P from the paddle 132 is slowly made perpendicular to the stack tray 82 in correspondence with the rotation of the holding member 130 after making contact with the sheet bundle P. The force of the paddle 132 for pushing up the lower end of the sheet bundle P is reduced.

Embodiment 4 of the Assisting Member and Holding Member

Figure 17:
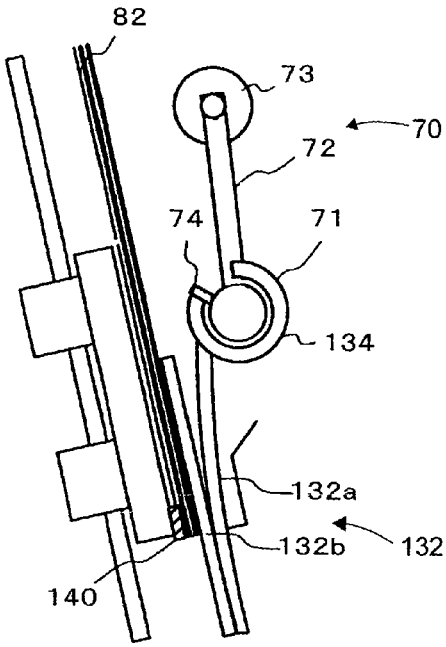
FIG. 17 is a schematic diagram for explaining still another example of the assisting member and holding member.

The paddle 132 shown in FIG. 17 includes a flexible first paddle 132*a* and a second paddle 132*b* connected to the leading edge of the first paddle 132*a*. In the second paddle 132*b*, the lower one end is fixed to the first paddle 132*a*. The upper other end of the second paddle 132*b* is separable from the first paddle 132*a*. The second paddle 132*b* may be or may not be a flexible member. In the second paddle 132*b*, as shown in FIG. 18, the center of the second paddle 132*b* may be fixed to the leading edge of the first paddle 132*a*.

Figure 18:
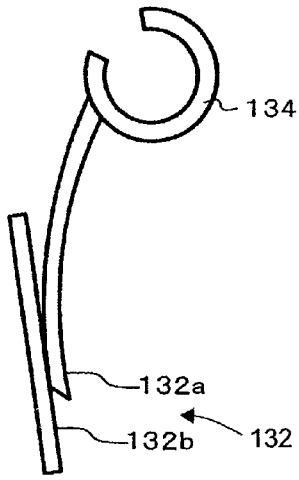
FIG. 18 is a schematic diagram for explaining a further example of the assisting member and holding member.

The paddle 132 shown in FIGS. 17 and 18 can hold the sheet bundle in the direction close to the perpendicular direction to the stack tray 82. Therefore, the paddle 132 shown in FIGS. 17 and 18 can eliminate the bending without lifting up the sheet bundle P.

Embodiment 5 of the Assisting Member and Holding Member

Figure 19:
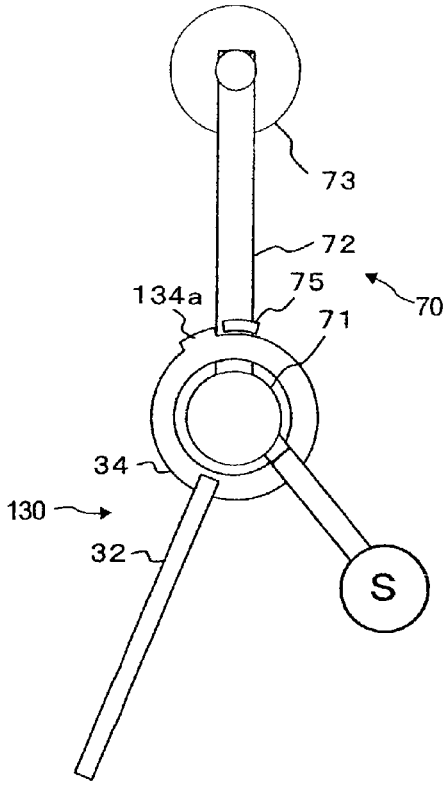
FIG. 19 is a schematic diagram for explaining a still further example of the assisting member and holding member.
Figure 20:
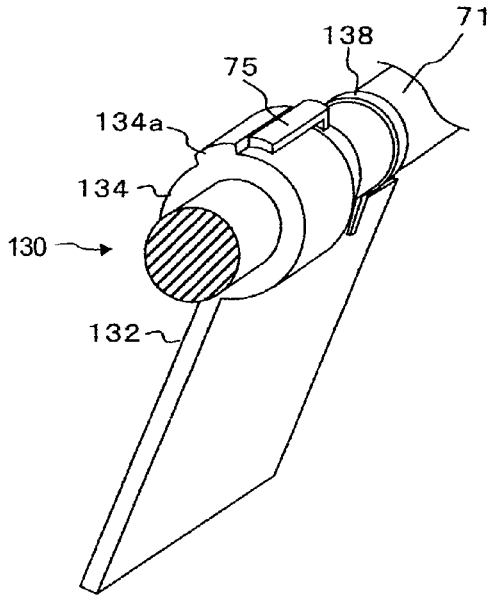
FIG. 20 is a schematic perspective view for explaining the assisting member and holding member shown in FIG. 19.

In this embodiment, another example of the assisting member 70 and holding member 130 will be explained. FIG. 19 is a cross sectional view of the assisting member 70 and holding member 130. FIG. 20 is a cross sectional view of the assisting member 70 and holding member 130.

The assisting member 70 includes the shaft 71, arm 72, and assist roller 73. The shaft 71 supports the stopper 75. The holding member 130 includes the paddle 132 and attaching portion 134.

The attaching portion 134 of the holding member 130 has a projection 134*a*. The projection 134*a* contacts with the stopper 75, thus the holding member 130 pressed by the elastic force of the spring 138 stops the rotation.

Although the invention is shown and described with respect to certain illustrated aspects, it will be appreciated that equivalent alterations and modifications will occur to others skilled in the art upon the reading and understanding of this specification and the annexed drawings. In particular regard to the various functions performed by the above described components, the terms used to describe such components are intended to correspond, unless otherwise indicated, to any component which performs the specified function of the described component (e.g., that is functionally equivalent), even though not structurally equivalent to the disclosed structure, which performs the function in the herein illustrated exemplary aspects of the invention.

What is claimed is:

1. A sheet stack apparatus comprising:

a storage portion configured to support sheets conveyed one by one in a standing position;

a receiving portion configured to receive lower ends of the sheets supported by the storage portion;

an assisting member configured to move between a first position where the assisting member is separated from the storage portion and a second position where the assisting member contacts with the sheets conveyed to the storage portion, and to assist stacking of the sheets on the storage portion; and a holding member configured to move in correspondence with a movement of the assisting member via an attaching portion, the holding member separating from the lower ends of the sheets when the assisting member is at the second position, and the holding member contacting with the lower ends of the sheets when the assisting member is at the first position, the holding member including a flexible first paddle attached to the assisting member via the attaching portion and a second paddle provided on a leading edge side of the first paddle, the second paddle having an end part on a side of the attaching portion that is provided removably on the first paddle to contact with the lower ends of the sheets supported by the storage portion.

2. The apparatus according to claim 1 further comprising:

an elastic member configured to press the holding member toward the storage portion.

3. The apparatus according to claim 1, wherein the attaching portion, before the assisting member moves to the first position, when the holding member contact with the sheets on the storage portion, holds the holding member independently of the movement of the assisting member to the first position.

4. The apparatus according to claim 1 further comprising:

a stitch portion configured to stitch a sheet bundle stacked on the storage portion, wherein the assisting member separates from the sheet bundle and the holding member contacts with and holds the lower end of the sheet bundle when stitching the sheet bundle by the stitch portion.

5. The apparatus according to claim 1, wherein the assisting member separates from the sheet bundle and the holding member contact with and holds the lower end of the sheet bundle when the receiving portion for receiving the lower ends of the sheets moves.

6. The apparatus according to claim 1, further comprising:

a stopping member configured to restrict the holding member from rotating toward the storage portion on the storage portion side.

7. A sheet stacking method comprising:

supporting sheets conveyed one by one in a storage portion in a standing position;

receiving lower ends of the sheets supported in the storage portion;

moving an assisting member between a first position where the assisting member separates from the storage portion and a second position where the assisting member contacts with the sheets conveyed to the storage portion, to assist stacking of the sheets on the storage portion; and moving a holding member in correspondence with a movement of the assisting member via an attaching portion separating the holding member from the lower ends of the sheets when the assisting member is at the second position, and contacting the holding member with the lower ends of the sheets when the assisting member is at the first position, the holding member including a flexible first paddle attached to the assisting member via the attaching portion and a second paddle provided on a leading edge side of the first paddle, the second paddle having an end part on a side of the attaching portion that is provided removably on the first paddle to contact with the lower ends of the sheets supported by the storage portion.

8. The method according to claim 7 further comprising:

pressing the holder member toward the storage portion by an elastic member.

9. The method according to claim 7, wherein the attaching portion, before the assisting member moves to the first position, when the holding member contacts with the sheets on the storage portion, holds the holding member independently of the movement of the assisting member to the first position.

* * * * *